US009104179B2

(12) United States Patent
Jamin et al.

(10) Patent No.: US 9,104,179 B2
(45) Date of Patent: Aug. 11, 2015

(54) WINDING MASS

(71) Applicant: Christian Dior Couture SA, Paris (FR)

(72) Inventors: Mathieu Jamin, Champigny sur Marne (FR); Vincent Lepoultier, Colombes (FR); Etienne Lebreton, Renens (CH)

(73) Assignee: Christian Dior Couture SA, Paris (FR)

( * ) Notice: Subject to any disclaimer, the term of this patent is extended or adjusted under 35 U.S.C. 154(b) by 0 days.

(21) Appl. No.: 14/371,663

(22) PCT Filed: Jan. 10, 2013

(86) PCT No.: PCT/EP2013/050432

§ 371 (c)(1),
(2) Date: Jul. 10, 2014

(87) PCT Pub. No.: WO2013/104732

PCT Pub. Date: Jul. 18, 2013

(65) Prior Publication Data

US 2015/0003216 A1 Jan. 1, 2015

(30) Foreign Application Priority Data

Jan. 13, 2012 (CH) ..... 0067/12

(51) Int. Cl.

| | |
|---|---|
| ***G04B 5/16*** | (2006.01) |
| ***G04B 45/00*** | (2006.01) |
| ***G04B 45/02*** | (2006.01) |

(52) U.S. Cl.

CPC *G04B 5/165* (2013.01); *G04B 5/16* (2013.01); *G04B 45/0046* (2013.01); *G04B 45/02* (2013.01); *Y10T 156/1074* (2015.01)

(58) Field of Classification Search

CPC ..... G04B 5/16; G04B 5/165; G04B 45/0046; G04B 45/02

See application file for complete search history.

(56) References Cited

U.S. PATENT DOCUMENTS

| | | | | | |
|---|---|---|---|---|---|
| 4,910,720 | A | * | 3/1990 | Ray et al. | 368/148 |
| D480,979 | S | * | 10/2003 | Filiberti | D10/128 |
| D481,323 | S | * | 10/2003 | Filiberti | D10/128 |
| D481,644 | S | * | 11/2003 | Filiberti | D10/128 |
| D539,182 | S | * | 3/2007 | Perret | D10/128 |
| D624,840 | S | * | 10/2010 | Behling | D10/129 |
| D630,960 | S | * | 1/2011 | Vogeli | D10/128 |
| D635,045 | S | * | 3/2011 | Rodriguez | D10/128 |
| D640,582 | S | * | 6/2011 | Behling | D10/128 |
| 8,882,340 | B2 | * | 11/2014 | Kaelin et al. | 368/148 |
| D725,530 | S | * | 3/2015 | Graff | D10/129 |
| 2006/0050617 | A1 | * | 3/2006 | Papi | 368/203 |
| 2012/0243387 | A1 | * | 9/2012 | Jamin et al. | 368/151 |

FOREIGN PATENT DOCUMENTS

| | | | |
|---|---|---|---|
| CH | 566038 | B5 | 8/1975 |
| CH | 695394 | A5 | 4/2006 |
| DE | 19924775 | C1 | 9/2000 |
| EP | 2230570 | A2 | 9/2010 |

* cited by examiner

*Primary Examiner* — Vit W Miska
(74) *Attorney, Agent, or Firm* — Blank Rome LLP

(57) ABSTRACT

The invention relates to a winding mass (10) for a watch movement, comprising a geometric rotation axis (100), a peripheral portion (10) and a connecting portion (13) between the peripheral portion (10) and the rotation axis (100), the density and the mass of the peripheral portion being greater than those of the connecting portion. The connecting portion (13) is moved by means of bird feather-like portions (20).

14 Claims, 5 Drawing Sheets

WINDING MASS

REFERENCE DATA

This application is a National Phase of PCT Application No. PCT/EP2013/050432, filed Jan. 10, 2013, which claims priority to Swiss Patent Application No. CH0067/12, filed on Jan. 13, 2012, the content of which is incorporated here by reference.

TECHNICAL FIELD

The present invention relates to winding masses for automatic watches.

PRIOR ART

Fine mechanical watches prove fascinating notably as it is possible to watch miniscule mechanical components move. Watching the movement of mechanical components is, however, possible only in the case of skeleton watches which have no dial, or at least of watches that have openings through the dial or the back. Moreover, most of the mechanical components are driven in a very slow, almost invisible, movement and only the oscillating mass, the second hand and the regulator are generally driven with a movement that is fast enough to be perceptible.

In order to animate the dial of watches which do not allow the movement to be seen, watches are therefore known which are provided with animations on top of the dial, i.e. with mechanical components moving over the dial. These animations can also be used as additional animations in watches in which the watch movement can be seen.

Known for example from the prior art are watches comprising diamonds or other objects which move freely over the dial under the effect of gravity and accelerations.

Also known are watches in which the oscillating mass is positioned in front of the dial to make it more visible and thus create an animation as it moves, while at the same time rewinding the automatic watch movement. An example is described in WO2009/056498.

However, an oscillating mass occupies a significant portion of the dial and this may make the dial look monotonous. CH695394 describes a watch with an oscillating mass, the attractiveness of which is heightened by a decorative element visible at the surface of the mass, for example a diamond or a stone which reflects the light. A diamond, while eye catching, does nevertheless remain immobile in relation to the mass.

In order to provide the watch with a greater degree of animation, it is also known practice to equip the oscillating mass with elements or objects that can move relatively to this mass. For example, WO2010/081500 describes a watch in which part of the mechanism of the watch movement is mounted on an oscillating mass visible on the front face.

CH993971 describes a watch making dial the back of which is made of bird feather barbs. That document also describes the method of manufacturing this dial, which comprises the following steps: attaching a bird feather to the dial plate, the feather having dimensions greater than that of the dial, applying a transparent varnish to the feather in order to hold the barbs together and finally trimming off that part of the feather that protrudes beyond the dial plate. The final shape of the feather is associated with that of the dial plate.

DE19924775 describes another method of manufacturing a dial comprising the barbs of a bird feather, notably from a falcon, in which the feather parts protruding beyond the dial are trimmed off with a scalpel or with a hot cutting wire.

In the latter two documents (CH993971 and DE19924775) the feathers are bonded to the entirety of the surface area used and then trimmed off. They are therefore used as covering surfaces. Furthermore, they remain immobile in relation to the watch.

The mechanism needed for driving the moving elements on an oscillating mass in front of the dial is, however, complex and intricate. Moreover, even though the oscillating mass constitutes an unbalance, so that it oscillates under the effect of gravitation, it is preferable for the mass thereof to be distributed uniformly at the periphery, in order to avoid unbalancing it and creating heavy load on the central axis of rotation of the oscillating mass. In other words, the moving elements fitted to the oscillating mass need to be lightweight and, if possible, evenly distributed over various angular sectors that make up the oscillating mass.

It is also desirable for the oscillating mass to be provided with animated elements that draw a minimum amount of energy from the watch movement, in order not to reduce the power reserve thereof.

It is also desirable to produce a winding mass with a moment of inertia that is as high as possible, although without making it too heavy because the watch should not be made any heavier than is necessary. To this end, it is desirable to have a great deal of mass near the periphery, in order to increase the moment of inertia, and a mass that is as light as possible between this periphery and the center, in order to keep the watch light.

EP2230570 relates to a timepiece, for example an oscillating mass which is made lighter using triangular recesses. The center of gravity of the oscillating mass thus obtained is shifted toward the periphery while at the same time maintaining the rigidity of the component.

A winding mass generally comprises a solid peripheral annulus in the form of an arc of a circle and connecting elements, for example arms or spokes, connecting the peripheral annulus to the center of pivoting of the mass. These arms define openings through which the elements behind and/or in front of the oscillating mass can be seen at least partially, while at the same time keeping the weight of the mass down.

These connecting elements are often made of the same metal as the peripheral annulus which is made of a heavy metal, and need to be massive and rigid enough to transmit significant torque without deforming. They are therefore often considered to be unattractive, particularly in the case of luxury watches.

To remedy these disadvantages the prior art has various ways of concealing or cladding these arms in order to improve their appearance. There is therefore a need for solutions that allow these arms to be concealed, without making them heavier. Furthermore, it is desirable to clad or cover these arms without concealing the dial or the hands, or other elements of the watch movement behind the oscillating mass.

One solution to this problem, which has been proposed by the applicant, provides an oscillating mass in which the connecting element is set with a plurality of stones, notably of diamonds.

Stones, notably precious stones, have long been used in luxury horology, and using them on an oscillating mass is therefore a legitimate use. However, the mass of the stones is not insignificant and this detracts from the qualities of the watch. On top of that, the thickness of the stones combines with that of the mass so that this solution is ill suited to super-slim watches.

There is therefore a need for a solution that allows the arms of an oscillating mass, or of other elements of the watch, to be hidden without excessively increasing the mass or the decorated component. In particular, there is a need for a solution that allows the arms of an oscillating mass to be hidden or clad with materials that are compatible with a product placement in the world of luxury and which is able to take the user by surprise. The oscillating mass needs to be able to move with a minimum resistance to rotation. Even though the oscillating mass moves slowly, some of the resistance is nevertheless due to friction against the air. As a result, in order to increase the power reserve, it is also desirable to keep a surface of the oscillating mass sufficiently aerodynamic and avoid animations on the oscillating mass that might slow the penetration of the oscillating mass through the air.

Moreover, in order to make the watch immediately identifiable and unique, it is also desirable to use precious and unexpected materials in order to meet these various objectives.

It is therefore one object of the present invention to propose an oscillating mass which combines these various objectives while at the same time offering a novel and unexpected look.

According to the invention, these objects are notably achieved by means of an oscillating mass which displays the features of claim 1 and by means of a method of manufacturing a winding mass according to claim 12.

The use of bird feather portions as part of the connecting element between the axis and the periphery of the mass allows to animate the oscillating mass thanks to the feather portions which move noticeably as the mass moves. The mass of the feather portions is very low, which means that they do not unbalance the oscillating mass even if they are distributed irregularly, and that they do not make the watch heavier. Furthermore, their aerodynamic is excellent.

Advantageously, each feather portion is obtained by stamping a bird feather and comprises a portion of the rachis of the bird feather. In this context, the word "rachis" (or shaft) denotes the central axis of the bird feathers, which bears the barbs. The lower part of the rachis which is not made up of dead cells is the calamus (or quill). The rachis is made essentially of keratin which has a high degree of elasticity in bending and is very strong. In general terms in a feather the diameter of the rachis tapers progressively from base of the feather to the tip thereof. Moreover, the angle between the barbs and the rachis also becomes increasingly smaller.

In a preferred alternative form the feather portion is in the shape of a whole feather.

The feathers are mounted on the winding mass which is an element capable of moving in relation to the dial and/or the case of the watch. In another alternative form, these feathers are mounted on any type of element of a watch which is able to move relative to the dial and/or the case of the watch, for example and nonlimitingly a hand, a roller, a rotor, a counter, a wheel, etc.

In a preferred alternative form, the feather portions are oriented in a plane normal to the axis of rotation of the mobile element, thus making it possible to avoid impeding the movement of the mobile element through friction with the air. Advantageously and surprisingly the feather portions can move in a plane parallel to the dial of the watch and therefore in a direction perpendicular to that of their movement in nature, which is generally perpendicular to the dial of the watch.

Advantageously, the feather portion used is obtained by stamping it from a natural bird feather, which may or may not be artificially colored. In an alternative form the feather portion may coincide with the whole feather used.

The b-keratin composition of natural feathers offers resistance against rotting under the low-moisture conditions of the external parts of a watertight watch and the flexibility necessary for handling during the working and bonding phases.

The feathers used are preferably remiges or remige portions stamped from the vane around the rachis. They may have a shaft oriented radially between said axis of rotation and the periphery, and barbs.

Various tests and trials have been carried out by the applicant in order to select feathers suited to being stamped in order to be used in a watch, notably a luxury watch. This is because only certain feathers are suited to this use. First of all, the diameter of the rachis at the tip end of the feather needs to be slender enough to allow the dial, hands, moving oscillating mass and feathers to be stacked up without impeding the operation of the watch. For example, the rachis diameter needs to be smaller than 0.5 mm.

Secondly, the angle between the rachis and the barbs needs to be large enough for the oscillating mass to be sufficiently covered.

The winding mass may have two superposed levels of feathers in order to conceal the dial sufficiently behind the feathers and the rigid connecting elements. The feathers may be semitransparent, so that the level of feathers behind can be seen by transparency.

The winding mass may comprise one or more rigid spokes between the axis of rotation and the periphery, the spokes being at least partially covered by said feathers. These spokes allow forces and movements to be transmitted between the heavy periphery of the winding mass and the central axis. The use of spokes between the center and the periphery also allows the oscillating mass to be made lighter. The use of a continuous peripheral portion of a density higher than that of the connecting portion allows the moment of inertia of the winding mass to be increased.

The spokes that constitute the connecting portion connecting between the center and the periphery may be radial. They may be non-radial, for example in the form of a grating. The periphery may be connected to the central axis by a single spoke, for example a plate in the form of an annular segment covered by feathers. The spokes may be made of metal. They may be transparent, for example made of sapphire. The spokes may all be covered by the feathers. Certain spokes may be covered by the feathers. Certain spokes may be visible. The mass may comprise different spokes of different shape, color, materials or orientation.

The spokes may have a color different than the color of the feathers. The spokes may have the same color as the dial behind the spokes.

The feathers are therefore mounted on a perforated element that allows the transparency of the feather in relation to the elements situated behind the oscillating mass or on the dial to be put to good use. Indeed the gridwork formed by the barbules and the barbs of a feather does not provide full coverage: a feather will therefore always maintain a certain degree of transparency. For example, the end of the feathers may partially hide stones, for example diamonds, situated in the external periphery of the oscillating mass thereby offering it unprecedented luminosity and iridescence effects.

The feathers may be bonded to the winding mass by the end of their shaft only. The vane may be free, so as to allow the barbs or the ends of at least certain barbs to flutter and move as the winding mass moves. The end of the shaft of each feather may be bonded to an annulus near the axis of rotation of the winding mass.

In a preferred alternative form, each feather portion is bonded only to the two ends of the rachis, leaving the barbs and barbules free and allowing them to move to a limited extent, for example as the oscillating mass moves. The impression of a feather is therefore more realistic than when the feather is fully stuck down so that it covers a component. This bonding, performed for example using an invisible adhesive, also allows the feather to be attached by its most wettable parts (the calamus and the rachis) rather than by the barbs and the barbules.

The feathers may be whole feathers. As discussed, for preference, the feathers are feather-shaped portions stamped from whole feathers, for example from remiges, in order to give them all the desired shape and size. They may be stamped out with a cutter with precise geometric control over their geometric shape. The feathers may all have the same shape and the same size. The feathers may be obtained by stamping out a small feather-shaped portion from the vane of a far larger selected feather. Each stamped-out portion may comprise a portion of the rachis of the original feather. The stamped-out portion may be stamped out near the tip of the initial feather. Different feathers may be deliberately stamped out at different distances on different feathers in order to obtain feathers with barbs that are shorter or longer and with varying degrees of freedom and softness.

During the cutting-out process it is possible either to leave the ends of the barbs situated at the tip of the feather intact or to trim the very ends thereof into the desired shape. It is also possible to determine the length of the feather precisely.

The slight non-flatness of the feather is brought under control by bonding the two ends of the feathers. Finally, the slight curvature of the barbs is also taken into consideration in the proximity of the feather to the hands.

The feathers may be chemically treated in order to preserve them. The feathers may be treated with preservatives, pesticides, agents that prevent them from becoming discolored. They may be dyed. They may be covered with a varnish to hold the barbs and protect them. They may be treated with ozone. They may be treated with ultraviolet radiation. They may be treated to protect them against ultraviolet radiation.

The use of feathers in watch making in the prior art was hitherto confined to a covering decorative appearance, lying flat and motionless in the external parts. The present invention for the very first time and unexpectedly makes use of the partial transparency of feathers, of their freedom of movement, of their natural geometry, and of the functions whereby the barbules cling to one another and of the natural break and various levels of wettability of feathers according to the subdivisions (calamus, rachis, barb, barbules) thereof.

Furthermore, arranging these feathers on a moving element such as an oscillating mass has no negative functional impact on the watch as a result of their orientation. Advantageously, the various levels of wettability of the parts of a feather with adhesive have been taken into consideration in order to maximize the reliability of the oscillating mass. Finally, the method of cutting out the feather portions allows the natural tips of the feathers to be used while at the same time maintaining geometric control over their shape.

BRIEF DESCRIPTION OF THE FIGURES

Exemplary embodiments of the invention are given in the description illustrated by the attached figures in which.

EXEMPLARY EMBODIMENT(S) OF THE INVENTION

Figure 1:
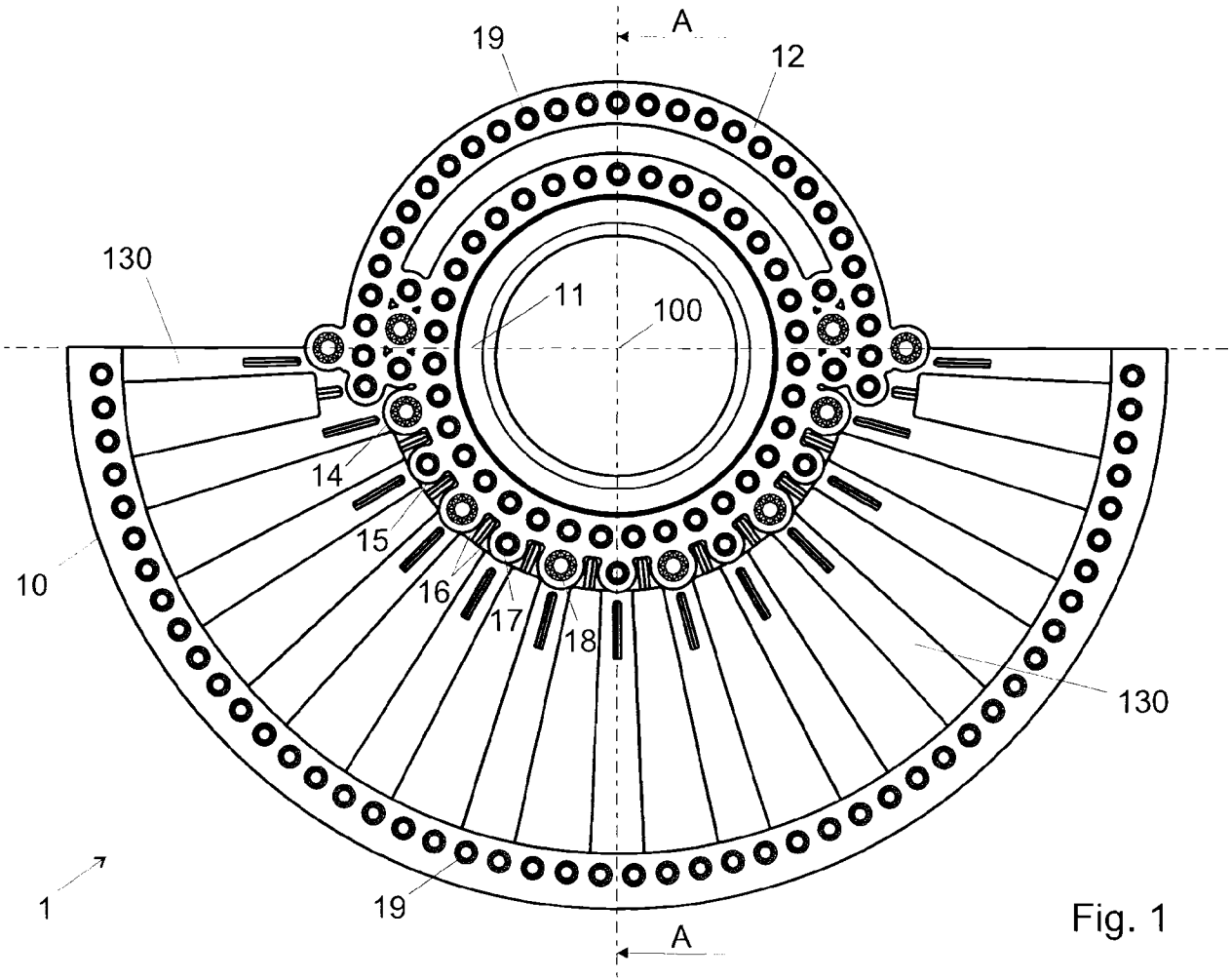
FIG. 1 illustrates a view from above of the oscillating mass before the feathers are fitted.

FIG. 1 illustrates a front view of a winding mass 1 intended to be fitted to a mechanical watch in order to wind the barrel and/or animate the front face. In this application, a "winding mass" is the term we use to describe any mass that oscillates under the effect of gravity even if this mass is decorative and does not necessarily play a part in winding the watch movement.

The winding mass 1 is advantageously designed for mounting on the front face of the watch, for example on top of the dial. However, it is also possible to use an oscillating mass according to the invention to fit in the rear of the watch movement.

The oscillating mass 1 in this example comprises a peripheral portion 10 in the form of an annular segment, for example a segment covering an angle of between 120 and 180°, preferably approximately 180°. The peripheral portion 10 is advantageously made of a high-density material, for example a precious metal such as gold or platinum, or of steel. A significant proportion of the mass of the assembly 1 is concentrated in the peripheral annulus 10 so that the center of gravity of the oscillating mass is as far as possible away from the axis of geometric rotation 100.

A connecting portion 13 with spokes 130 connects this peripheral portion 10 to an internal annular portion 11, 12 comprising a ring 11 forming the hub of the mass, and a decorative portion 12. The connecting portion may be made with the same material as the peripheral portion, for example a precious metal or steel, or from a different material. Each spoke 130 connects a point of the internal annular portion 12 to a point of the peripheral annulus 10. The kinetic energy brought about by the oscillations of the peripheral portion 10 is transmitted to the internal bearing 11 through this connecting portion 13 which needs to be sufficiently rigid, but sufficiently light that it does not make the watch heavier and to save on the amount of metal used. The space between the spokes 130 is sufficient to see the dial or the watch movement behind the winding mass, at least when this mass is not equipped with feathers. In a preferred embodiment, the connecting portion 13 is the same color as the watch dial (not depicted) behind the oscillating mass, to make it as invisible as possible. Other elements may be used to connect the peripheral portion 10 to the internal annular portion 11, 12; for example non-radial arms may be used, arms which cross, a grating, concentric arms, a plate which may or may not have openings, etc. The symmetric layout about a vertical axis of symmetry in the figure allows a good balancing of the mass. The connecting portion 13 may be made of metal, for example of stainless steel, or of precious metal. The connecting portion 13 may also be transparent, for example made of sapphire.

The internal annular portion 11, 12 comprises cornices 14, 15 extending radially facing each spoke 130. In this example, the winding mass 1 comprises an alternation of large cornices 14 and of small cornices 15. Stones, for example diamonds, may be fitted into at least some of these cornices 14, 15. The cornices make it easier to hide the end of the feathers not covered by the feathers 20 and to attach the shaft 200 of the feathers 20. In one embodiment, a first level of feathers is attached by bonding the end 202 of the shaft 200 of each feather 20 of this first level to a cornice 14, 15 and a second level of feathers 20 is attached by bonding the end 202 of the shaft 200 of each feather of this second level into a gap 16 between a large cornice 14 and a small cornice 15. In this way, the feathers of the second level are placed alternately between the feathers of a first level, with a partial overlap.

The peripheral portion 10 also comprises a plurality of inset stones 19, thus contributing to enhancing its appearance.

The annular portion 11, 12 comprises a bearing 11 which allows the winding mass 1 to be connected in a pivoting fashion to an automatic watch movement. In an alternative form, the winding mass 1 is connected to the watch movement by the periphery, for example via a rack.

The spokes 130 of the connecting portion 13 have a non-optimal aerodynamic coefficient. Moreover, even if this winding mass moves over the front face of the watch, the animation is limited. As a result, in order to have more animation of this winding mass while at the same time improving its aerodynamics, the front face of the connecting portion is covered with feathers which are attached in such a way as to move slightly at the behest of the oscillations of the mass. As the weight of the feathers is extremely limited, it is possible for the feathers to be arranged slightly asymmetrically or to use feathers of varying size and weight, without thereby unbalancing the winding mass 1.

Figure 2:
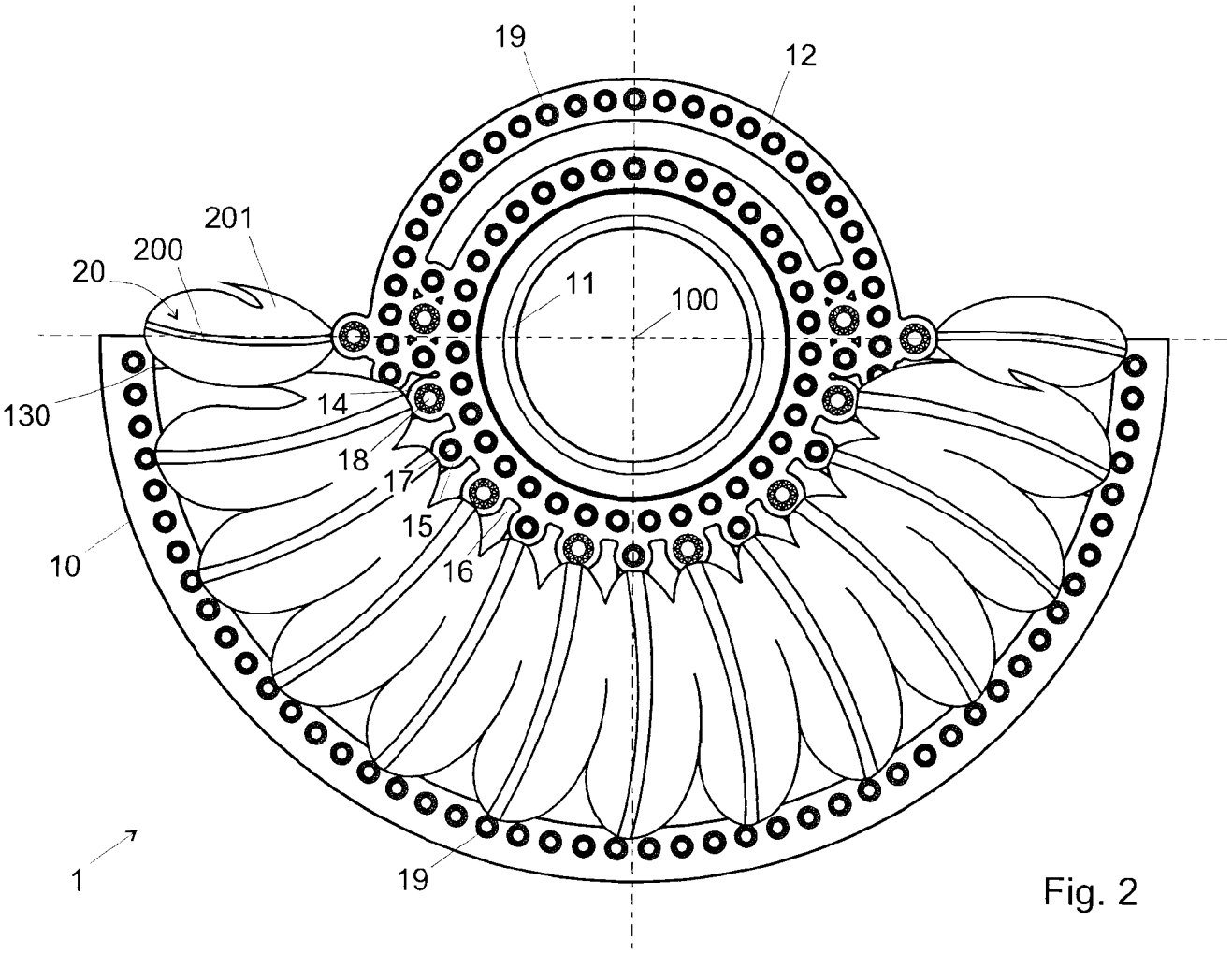
FIG. 2 illustrates a view from above of the winding mass after the feathers are fitted.
Figure 3:
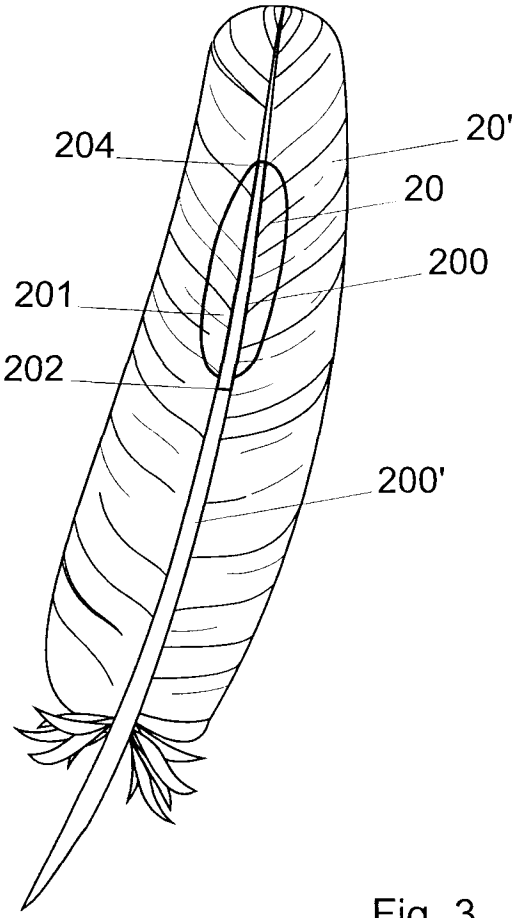
FIG. 3 schematically illustrates one example of the method of stamping out a feather.

FIG. 2 illustrates the winding mass of the invention to which one level of feathers 20 is bonded. In this example, the first level of feathers 20 comprises feathers arranged radially, one feather being placed on each spoke 130 so as to cover it fully or almost fully. The lower end 202 of the shaft 200 of each feather 20 is placed on the internal annular portion 11, 12, for example on each cornice 14, 15. This end may be bonded using an invisible adhesive and/or attached by mechanical means. A second level of feathers (not illustrated) may be bonded on top of this first level, for example with feathers alternating with those of the first level, for example by bonding and/or mechanically attaching the lower end of each feather into a gap 16 between two cornices 14, 15. The width of the feathers of the second level is preferably limited enough that at least a portion of the feathers of the first level can be seen; in addition, the feathers of the second level are preferably transparent enough that the feathers of the first level can be made out.

The feathers used are advantageously cock feathers carefully selected for their color and their condition. As it is difficult to obtain a great many feathers with the desired shape and size, and edges in good condition, the feathers used are preferably obtained by stamping out a feather-shaped portion 20 from the vane of a far larger selected feather 20'. The stamped-out shape comprises a portion 200 of the rachis of the basic feather, i.e. a portion of the shaft, and shortened barbs 201. Some feathers may be stamped out near the tip of the basic feather, in order to have finer barbs 201 which are not as closely knitted together. Other feathers, for example those used for the lower level, may be stamped out closer to the lower end of the shaft (calamus) in order to have stiffer more tightly knit barbs 201, which are more perpendicular to the shaft.

The feathers 20 are preferably bonded or attached by the end 202 of the shaft only. In an alternative form, at least some feathers are bonded at various points along their shaft to the corresponding spoke. In a preferred alternative form, the feather portions 20 are bonded to the spokes 130 by their upper end 204 and by their lower end 202. In both instances, the barbs are free to move as the winding mass moves.

Figure 4:
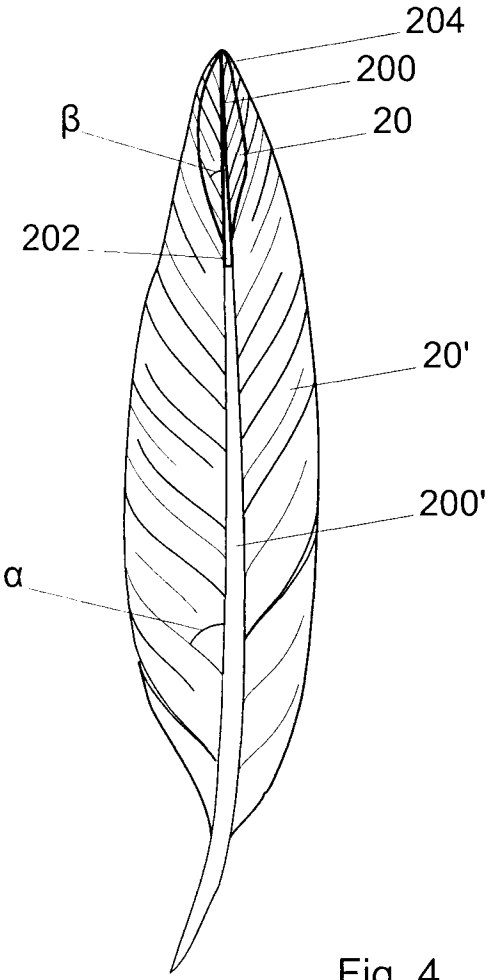
FIG. 4 schematically illustrates another example of the method of stamping out a feather.

FIG. 4 schematically illustrates another example of the feather stamping method. In this case, the feather portion 20 is stamped out near the upper end of the basic feather 20', in order to have finer, less tightly knit barbs 201. In keeping with the upper end of the basic feather 20', the rachis 200' of the basic feather 20' is more slender, making it possible to have a feather portion 20 of a thickness better suited to the thickness constraints of a watch.

Furthermore, the angle $\alpha$ between the rachis 200 and the barbs needs to be large enough to offer the feather portion 20 sufficient coverage of the oscillating mass 10. Feather portions 20 stamped out from the central part of the basic feather 20' have a rachis that is thicker but an angle $\beta$ between the rachis 200 and the barbs that is greater than $\alpha$.

Figure 5:
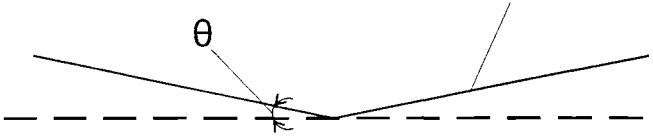
FIG. 5 is a diagram in cross section of a feather portion according to the invention.

FIG. 5 illustrates a diagram in cross section of a feather portion according to the invention. In general, a natural feather is not flat because it forms an angle of non-flatness $\theta$, visible in FIG. 5, in relation to a horizontal line. This angle $\theta$ has a small value, preferably less than 10°, for example 5°. This slight lack of flatness of the feather is kept under control by bonding the two ends 202, 204 of the feather portion 20. Finally, the slight curvature of the barbs is also taken into consideration when positioning the feather portion in the watch.

Figure 6B:
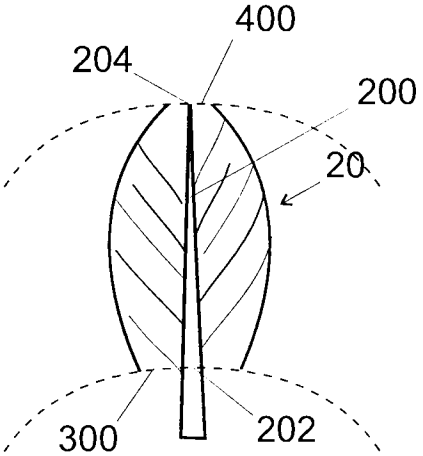
FIGS. 6A and 6B illustrate two examples of feather portions according to the invention.
Figure 6A:
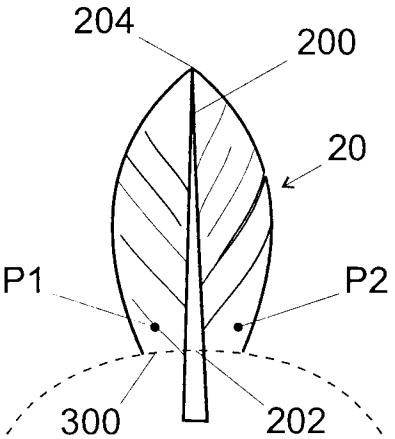

FIGS. 6A and 6B illustrate two examples of feather portions 20 according to the invention. The feathers are stamped out with a cutter with precise geometric control. During the cutting-out process, it is possible either to leave the ends of the barbs situated at the ends 202, 204 of the feather portion 20 intact, or to trim the far ends of these barbs to the desired shape, as illustrated in FIG. 6B. For example, it is possible to cut the lower end 202 of the feather portion 20 into the shape of a circular arc 300, as illustrated in FIG. 6A. Such feather portions 20 may advantageously be bonded to an oscillating mass as for example illustrated in FIG. 2, giving the impression that there are feathers coming out of the center 100 of the mass 10.

In that case, the feather portion may be bonded to the spokes 130 of the oscillating mass 10 at its upper end 204 and also at the points P1 and P2 near its lower end 202.

It is also possible to cut the upper end 204 of the feather portion 20 into an arc of a circle 400, as illustrated in FIG. 6B, in order to give the barbs a more even and precise shape.

The feathers may be chemically treated to preserve them for longer. They may be treated with pesticides, for example fungicides, herbicides, parasiticides or other phytosanitary products. They may be treated with preservatives. They may be treated with ozone and/or with ultraviolet radiation. They may also be treated against discoloration and attack by ultraviolet radiation. It is also possible to dye them and/or to cover them with a varnish in order to hold the barbs in position.

The oscillating mass according to the invention is designed to be incorporated into an automatic watch for winding the watch movement. Such a watch in the conventional way comprises an energy accumulator, often a barrel, designed to collaborate with the oscillating mass, in order to perform this function. Thus, the oscillating mass allows energy to be supplied to the accumulator, arming the spring thereof. The energy accumulator is used to power a time base of the watch movement, which time base itself drives the gear sets.

In an advantageous embodiment, the oscillating mass 10 is incorporated into an existing watch movement. To do this, an adapter plate is mounted on the basic mechanical watch movement of the watch. This plate houses gearing suited to providing the connection between the oscillating mass and the barrel.

The invention also, and independently, relates to other watch making components provided with bird feathers attached in a semi-free manner, i.e. in a manner that allows the barbs to move. Such feathers attached or bonded only by the shaft or the end of the shaft may for example be provided on the dial, the hands or other elements, preferably animated and visible elements, of the watch.

The invention claimed is:

1. A winding mass for a watch movement, comprising an axis of geometric rotation, a peripheral portion and a connecting portion between the peripheral portion and the axis of rotation, wherein the connecting portion is provided with bird feather portions, each feather portion being obtained by stamping a bird feather, each portion comprising a portion of the rachis of said bird feather, and barbs.

2. The winding mass as claimed in claim 1, said portion of the rachis is oriented radially between said axis of geometric rotation and said peripheral portion.

3. The winding mass as claimed in claim 1, said feather portion being in the shape of a feather.

4. The winding mass as claimed in claim 1, comprising two superposed levels of feathers.

5. The winding mass as claimed in claim 1, comprising rigid spokes between said axis of rotation and said peripheral portion, said spokes being at least partially covered by said feather portions.

6. The winding mass as claimed in claim 5, said spokes being made of metal.

7. The winding mass as claimed in claim 5, said spokes being made of sapphire.

8. The winding mass as claimed in claim 5, said spokes being radial.

9. The winding mass as claimed in claim 5, said spokes being of a color different than that of said feather portions.

10. The winding mass as claimed in claim 5, said feather portions being bonded to said spokes via the lower end of their rachis only.

11. The winding mass as claimed in claim 5, said feather portions being bonded to said spokes by the lower end of their rachis and by the upper end of their rachis.

12. A method of manufacturing the winding mass as claimed in claim 1, comprising the following steps:

selecting feathers;

stamping a feather-shaped feather portion from the vane of each selected feather, each stamped portion comprising a portion of the rachis;

bonding the rachis of the stamped feather portions onto a winding mass oriented radially with the rachis close to the axis of geometric rotation.

13. The method of claim 12, comprising a step of chemically treating said feather portions.

14. The method as claimed in claim 12, said feathers being bonded by their rachis only.

* * * * *